US005495534A

United States Patent [19]

Inanaga et al.

[11] Patent Number: 5,495,534

[45] Date of Patent: Feb. 27, 1996

[54] AUDIO SIGNAL REPRODUCING APPARATUS

[75] Inventors: Kiyofumi Inanaga; Hiroyuki Sogawa; Yasuhiro Iida; Yabe Susumu, all of Kitashinagawa, Japan

[73] Assignee: Sony Corporation, Tokyo, Japan

[21] Appl. No.: 230,018

[22] Filed: Apr. 19, 1994

Related U.S. Application Data

[63] Continuation of Ser. No. 762,017, Sep. 19, 1991, abandoned.

[30] Foreign Application Priority Data

Jan. 19, 1990 [JP] Japan ..... 2-008514
Jan. 19, 1990 [JP] Japan ..... 2-008520

[51] Int. Cl.[6] ..... H04R 5/00
[52] U.S. Cl. ..... 381/25; 381/74
[58] Field of Search ..... 381/74, 25

[56] References Cited

U.S. PATENT DOCUMENTS

| | | | |
|---|---|---|---|
| 3,962,543 | 6/1976 | Blauert et al. | 381/25 |
| 5,023,913 | 6/1991 | Matsumoto et al. | 381/63 |

FOREIGN PATENT DOCUMENTS

| | | | |
|---|---|---|---|
| 51-65901 | 6/1976 | Japan . | |
| 54-109401 | 8/1979 | Japan . | |
| 58-116900 | 7/1983 | Japan . | |
| 0044197 | 3/1984 | Japan | 381/25 |
| 0204200 | 10/1985 | Japan | 381/74 |
| 1121000 | 5/1989 | Japan . | |
| 0120999 | 5/1989 | Japan | 381/74 |
| WO89/03632 | 4/1989 | WIPO . | |

*Primary Examiner*—Curtis Kuntz
*Assistant Examiner*—Ping W. Lee
*Attorney, Agent, or Firm*—Hill, Steadman & Simpson

[57] ABSTRACT

In the audio signal reproducing apparatus, information on the transfer characteristics representative of the transfer characteristics from virtual sound sources to both ears of a listener in at least a first quadrant of the rotational angular position of the head M of the listener is stored in storing unit 22. The transfer characteristics in rotational angular position of the head M represented by detection outputs from detecting unit 5L, 5R and 13 for detecting the rotational angle position depending upon the movement of the head of the listener are formed based upon the transfer characteristics information of at least the first quadrant stored in the storing unit and left and right channel audio signals are processed by audio signal processing unit 23 for achieving a proper binaural reproduction relative to the virtual sound sources. Also in the audio signal processing apparatus of the present invention, information on the transfer characteristics from virtual sound sources to both ears of a listener for each given rotational angle depending upon the movement of the head M of the listener is stored in storing unit 62. The rotational angular position of the head of the listener is detected by detecting unit 45L, 45R and 53 at a solution higher than that of the information of the transfer characteristics stored in said storing unit. The information on at least two transfer characteristics in the vicinity of the rotational angular position represented by the detection outputs from detecting unit is read from the storing unit. The information on the transfer characteristics in the rotational angular position of the head represented by the detection output is interpolation operated by interpolation operating unit 61. Based upon the information on the transfer characteristics determined by the interpolation operation unit, left and right channel audio signals are processed by audio signal processing unit 63 for achieving a proper binaural reproduction relative to the virtual sound sources.

1 Claim, 6 Drawing Sheets

AUDIO SIGNAL REPRODUCING APPARATUS

This is a continuation, of application Ser. No. 07/762,017, filed Sep. 19, 1991, now abandoned.

FIELD OF THE INVENTION

The present invention relates to an audio signal binaural reproducing apparatus for reproducing audio signals by means of headphones.

BACKGROUND OF THE INVENTION

A binaural reproducing method has heretofore been known as an approach for providing better direction sensation of sound image or outside head localization sensation when audio signals are reproduced by headphones fitted to the head of a listener so that a pair of headphones are located in the vicinity of both ears.

An audio reproducing system adopting this binaural system preliminarily applies a given signal processing to the audio signals reproduced by headphones as is described in, for example, specification of Japanese Patent Publication Sho 53-283.

The direction sensation of sound image and outside head localization sensation and the like depend upon tile differences in volumes, times and phases of sounds listened by left and right ears.

The signal processing aims at causing in an audio output reproduced by the headphones, audio effects equivalent to those caused by the difference in distances between sound sources, that is, speaker systems and right and left ears of a listener and reflections and diffractions in the vicinity of the head of the listener when audio reproducing is performed, for example, by speaker systems remote for the listener. Such a signal processing is performed by convolution-integrating left and right ear audio signals with impulse responses corresponding to the above-mentioned audio effects.

Since the absolute position of the sound image is not changed even if the listener moves or turns his or her head when audio reproducing is performed by speaker systems remote from the listener, the relative direction and position of the sound image that the listener senses are changed. In contrast to this, since the headphones is turned together with the listeners head if the listener turns his or her head when audio reproducing is performed by a binaural method using headphones, the relative direction and position of the sound image which the listener senses are not changed.

If binaural reproducing is performed by using headphones in such a manner, a sound image is created in the head of a listener due to differences in displacement of the sound image relative to a change in direction of the listener's head. Therefore, it is difficult to locate the sound image in front of the listener. Furthermore, the front sound image has a tendency to lift up.

Accordingly, an audio signal reproducing system which detects a change in the direction of the listener's head and changes the modes of the signal processing based upon a result of the detection for providing a good front localization sensation in headphones has heretofore been proposed as is disclosed in Japanese Unexamined Patent Publication No. Sho 42-227 and Japanese Examined Patent Publication No. 54-19242. In such an audio signal reproducing system, a direction detecting device such as gyro compass and magnetic needle is provided on the head of the listener. A level adjusting circuit and a delay circuit and the like for processing the audio signals are controlled based upon a result of detection from the direction detecting device so that a sound image sensation which is similar to that of the audio reproducing using speaker systems remote from the listener is obtained.

In the prior art binaural reproducing system in which headphones are provided with a direction detecting device comprising a gyrocompass, an excellent sound image can be obtained by controlling the content of the signal processing which is applied to the audio signals depending upon changes in direction of the listener's head.

In order to control the content of the signal processing applied to the audio signals depending upon a change in direction of the listener's head, it is necessary to preliminarily measure the impulse responses, that is, transfer characteristics corresponding to audio effects given to audio signals of left and right ears for each predetermined rotational angle and to store a great amount of information on the transfer characteristics. The information is read from the storing means depending upon the change in direction of the head. The audio signal will be subjected to a necessary convolution-integration processing in real-time.

The present invention was made under such circumstances.

It is an object of the present invention to provide an audio signal reproducing apparatus having a simple structure using storing means having a low storing capacity which is capable of performing a binaural reproduction for providing a very natural localization of a sound image in which the positions of virtual sound sources are not changed by headphones even if a listener moves by reducing the amount of information on transfer characteristics from virtual sound sources necessary for binaural reproduction of audio signals with the headphones to both ears of the listener.

DISCLOSURE OF THE INVENTION

An audio signal reproducing apparatus of the present invention comprises means for detecting the rotational angular position of the head of a listener corresponding to the movement of the head of the listener relative to virtual sound sources; means for storing transfer characteristics information representative of transfer characteristics of direct sounds from virtual sound sources to both ears of the listener for each predetermined rotational angular position in at least the first quadrant; and audio signals processing means which based upon the transfer characteristics information of at least one quadrant stored in said storing means, forms the transfer characteristic information in the rotational angular position of the head represented by an detection output of said detecting means for processing left and right channel audio signals, whereby the left and right channel audio signals which have been processed by said audio signal processing means are reproduced as sounds by headphone means.

An audio signal reproducing apparatus of the present invention comprises means for storing transfer characteristics information representative of the transfer characteristics from virtual sound sources to both ears of a listener for each predetermined rotational angle corresponding to the movement of a head of the listener; means for detecting the rotational angular position corresponding to the movement of the head of the listener; interpolation operation means which reads from said storing means information in at least two transfer characteristic in the vicinity of the rotational angular position of the head represented by an detection output of said detecting means for interpolation-processing the read transfer characteristics information in the rotational angular position of the head represented by the detection output of said detecting means; and audio signal processing means for processing left and right channel audio signals with the transfer characteristics information determined by said interpolation operation means, whereby the audio signals Which have been processed by said audio signal processing means are reproduced as sounds by a headphone set.

BEST MODE FOR EMBODYING THE INVENTION

Figure 1:
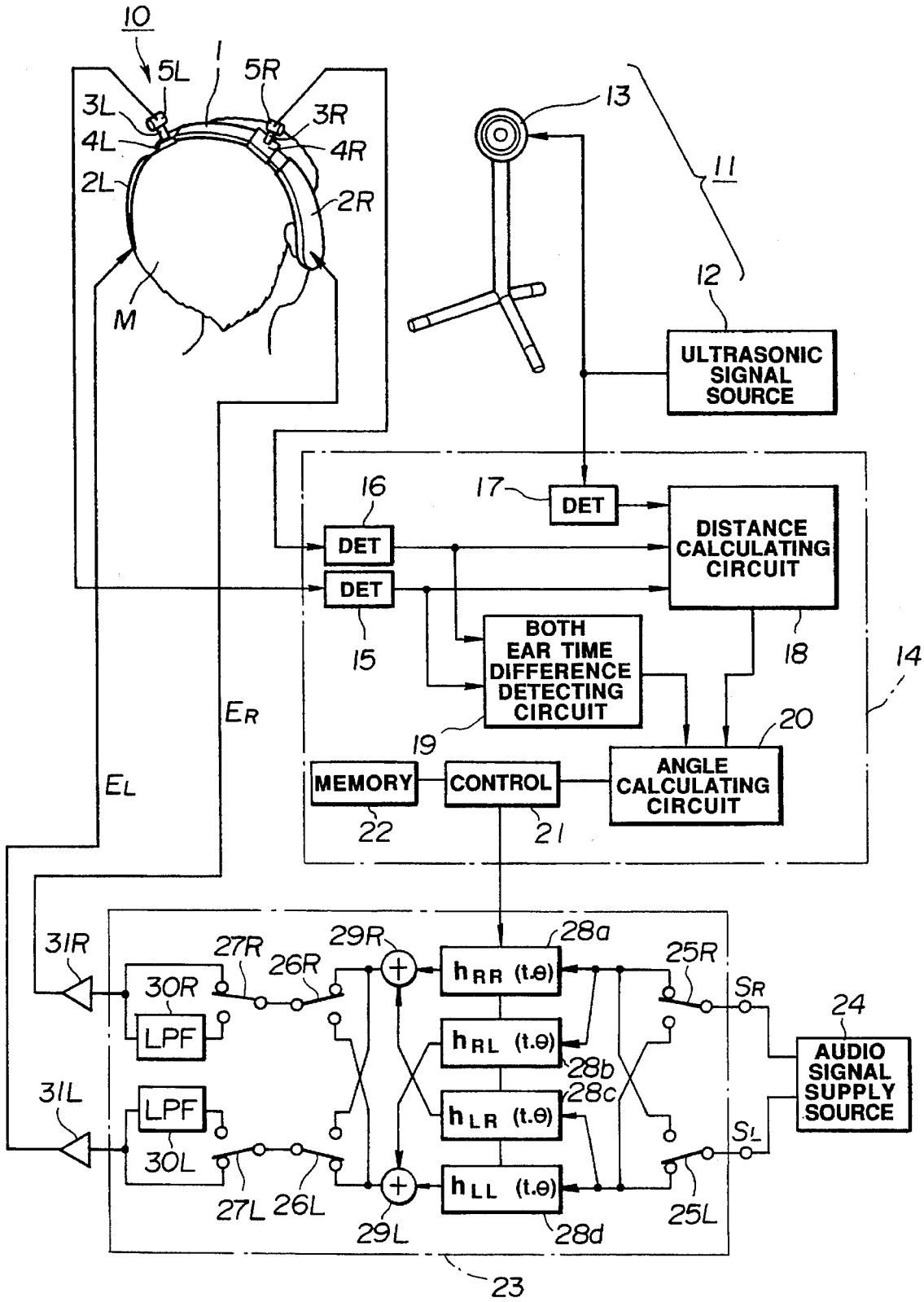
FIG. 1 is a block diagram schematically showing the structure of an audio signal reproducing apparatus of the present invention.

The audio signal reproducing apparatus of the present invention comprises a headphone set 10 which is fitted over the head M of a listener P and a pair of headphones 2L and 2R are supported by a head band 1 so that they are located in the vicinity of left and right ears of the listener P, respectively as shown in FIG. 1.

Two sliders 4L and 4R from which support arms 3L and 3R, respectively project are slidably mounted on the head band 1 of the headphone set 10. A pair of signal detectors 5L and 5R which detect a position detection reference signal emitted from a reference signal source 11 are provided at the tip ends of the support arms 3L and 3R, respectively. That is, the pair of signal detectors 5L and 5R are provided on the tip ends of the support arms 3L and 3R projectedly formed on the sliders 4L and 4R which are slidably mounted on the head band 1 so that they are supported in positions remote from the head band 1 and the pair of headphones 2L and 2R, that is the main body of the headphone set.

In the present embodiment, the reference signal source 11 comprises an ultrasonic signal source 12 and an ultrasonic speaker 13 for generating an ultrasonic signal from the ultrasonic signal source 12 as a reference signal. Each of the pair of signal detectors 5L and 5R which receive the reference signal comprises an ultrasonic microphone.

Figures 2A, 2B, 2C, 2D, 2E, 2F:
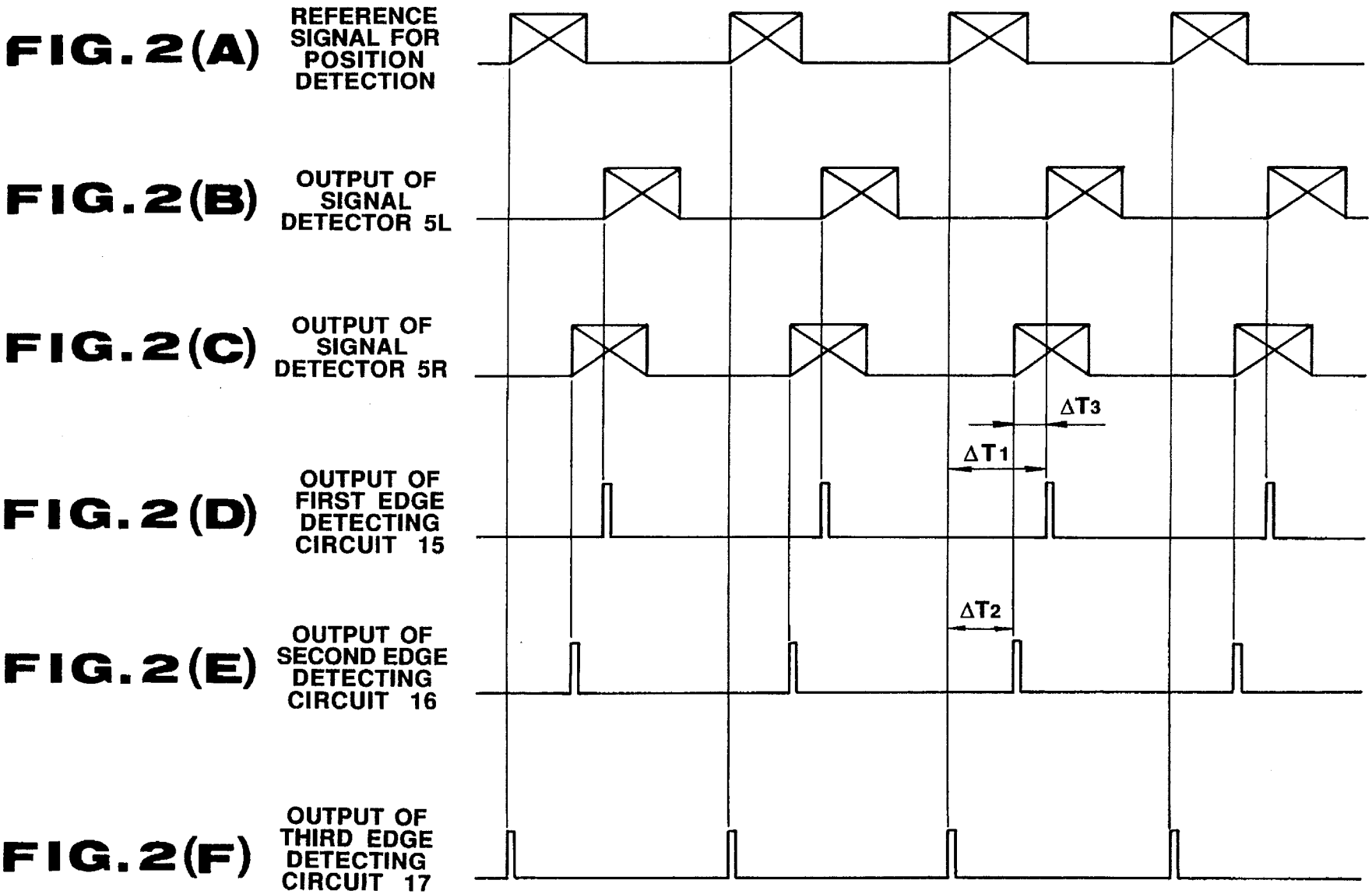
FIGS. 2(A)–2(F) are time charts schematically showing signals supplied to a operation unit of the audio signal reproducing apparatus.

An ultrasonic wave generated from the ultrasonic speaker 13, that is, the position detection reference signal is a burst wave in which an ultrasonic wave having a given level is intermittently generated for a given period of time as shown at A in FIG. 2, or an ultrasonic wave, the phase of which may be detected like a so-called level modulated wave, the level of which changes in a given circle.

The pair of signal detectors 5L and 5R provided on the headphone set 10 detects the ultrasonic position detection reference signal generated from the ultrasonic speaker 13 and generate respective detection signals shown at B and C in FIG. 2, each having a time lag depending upon the relative positional relation between the listener P and the ultrasonic speaker 13.

Since the pair of signal detectors 5L and 5R are supported by the support arm 3L and 3R in positions remote from the main body of the headphone set 10 and are mounted on the tip ends of the support arms 3L and 3R in positions remote from the main body of the headphone set 10 and, the main body of the headphone set is fitted on the head M of the listener P, they can detect the ultrasonic wave generated from the ultrasonic speaker 13, that is, the position detection reference signal stably and accurately without being located behind the head P of the listener P even if the listener P moves or rotates his head P. The pair of the signal detectors 5L and 5R can be adjusted to a position optimal for detecting the detection reference signal by sliding the sliders 4L and 4R along the head band 1. For example, the optimal positions of the headphones 2L and 2R which are fitted on the head M of the listener P by the head band 1 so that they correspond to the vicinity of the left and right ears depend on the shape and size of the had M of the listener P, that is, have the differences among individuals. Accordingly, the positions of the pair of signal detectors 5L and 5R can be adjusted so that they correspond to the headphones 2L and 2R, respectively.

Each detection signal obtained by these signal detectors 5L and 5R is applied to an operation unit 14.

The operation unit 14 comprises first and second edge detecting circuits 15 and 16, to which the detection signal from the signal detectors 5L and 5R for detecting the position detection reference signal are supplied, respectively and a third edge detecting circuit 17 to which an ultrasonic signal from the ultrasonic signal sources 12, that is, the position detection reference signal is applied.

The first and second edge detecting circuits 15 and 16 detect rise-up edges of the detection signals generated from the signal detectors 5L and 5R, respectively and output pulse signals shown at D and E of FIG. 2 corresponding to the rise-up edges pulse signals generated by the first and second edge detecting circuits 15 and 16 are supplied to a distance calculating circuit 18 and a circuit 19 for detecting the time difference between both ears. The third edge detecting circuit 17 detects the rise-up edge of the ultrasonic signal from the ultrasonic signal source 12 and outputs a pulse signal corresponding to the rise-up edge as shown at F in FIG. 2. A pulse signal obtained by the third edge detection circuit 17 is supplied to the distance calculating circuit 18.

Figure 3:
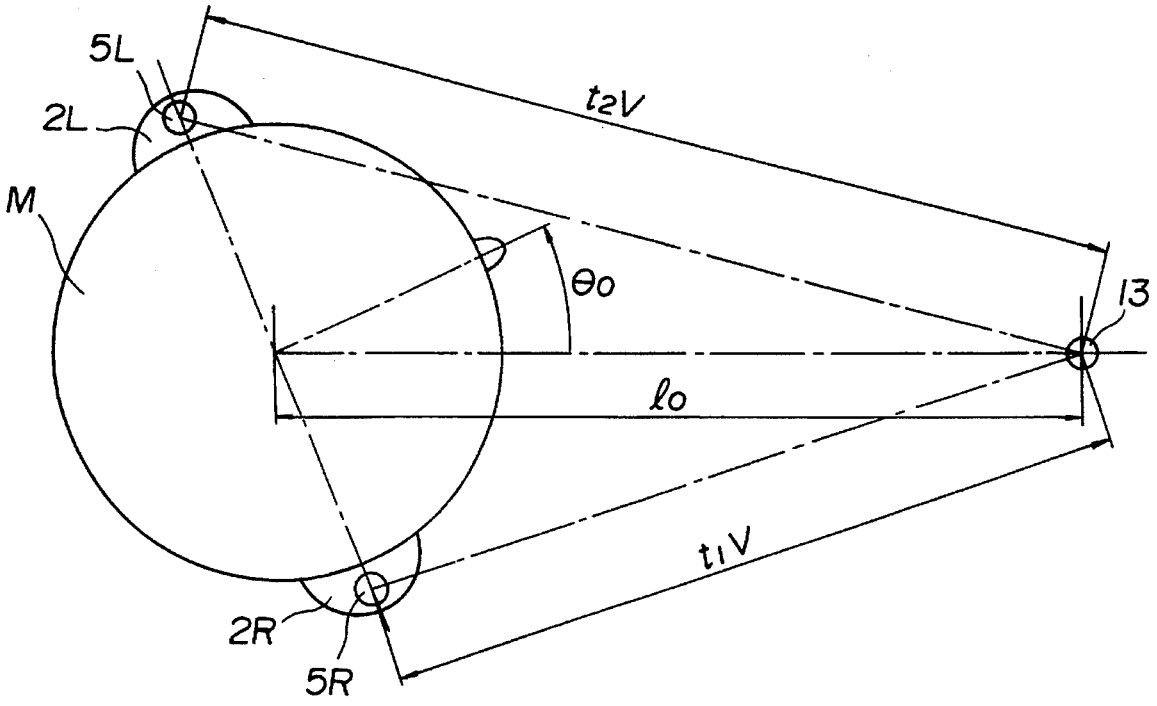
FIG. 3 is a schematic diagram illustrating the distance and the angle calculated by the operation unit of the audio signal reproducing apparatus.

The distance calculating circuit 18 detects the time difference $t_1$ between pulse signals obtained by the third and first edge detecting circuits 17 and 15 which is represented as $\Delta T_1$ in FIG. 2 and the time difference $t_2$ between pulse signals obtained by the third and second edge detecting circuits 17 and 16 which is represented as $\Delta T_2$ in FIG. 2 and then calculates the distance $\iota_0$ between the ultrasonic speaker 13 and the center of the head M of the listener P represented as $\iota_0$ in FIG. 3 based upon the time differences $t_1$, $t_2$ and the sound velocity V.

The sound velocity V may be preliminarily preset as a constant in the distance calculating circuit 18 or alternatively may be changed with changes in atmospheric temperature, humidity and atmospheric pressure and the like. On calculating the distance $\iota$, compensation may be conducted for the positional relation between the signal detector 5L and 5R and the center of the head M, the shape and size of the head M.

Signals representative of the distance $\iota_0$, time differences $t_1$ and $t_2$ are fed to an angle calculating circuit 20.

The circuit 19 for detecting the time difference between both ears detects the time difference $t_3$ between the pulse signals generated by the first and second edge detecting circuits 15 and 16, represented as $\Delta_3$ in FIG. 2. A signal representative of the time difference $t_3$ is fed to the angle calculating circuit 20.

The angle calculating circuit 20 calculates an angle representative of the direction of the head M represented by an angle $\theta_0$ in FIG. 3 by using the time differences $t_1$, $t_2$, $t_3$, the distance $\iota_0$, the sound velocity V and the radius r of the head M. The angle $\theta_0$ can be determined, for example, by the equation 1 as follows:

$$\theta_0=\sin^{-1}\{V^2(t_1+t_2)t_3/4r\iota\} \quad (1)$$

Then, the rotation angle $\theta$ of the head M relative to a desired position of a virtual sound source is calculated from information on the angle $\theta_0$ and the distance $\iota_0$ representative of the relative positional relationship between a reference position and the listener P by assuming that the position of the ultrasonic speaker 13 is the reference position of the virtual sound source.

Information on the rotation angle of the head of the listener obtained by the angle calculating circuit 20 is provided to a control circuit 21.

In the audio signal reproducing apparatus of this embodiment, the operation unit 14 includes a storing circuit 22 in which information is stored for transfer characteristics from the virtual sound source to both ears of the listener in at least the first quadrant of the rotational angular position of the head of the listener, for example, information on the transfer characteristics for each angle $\theta_{11}$ to $\theta_{1n}$ in the first quadrant.

Figure 4:
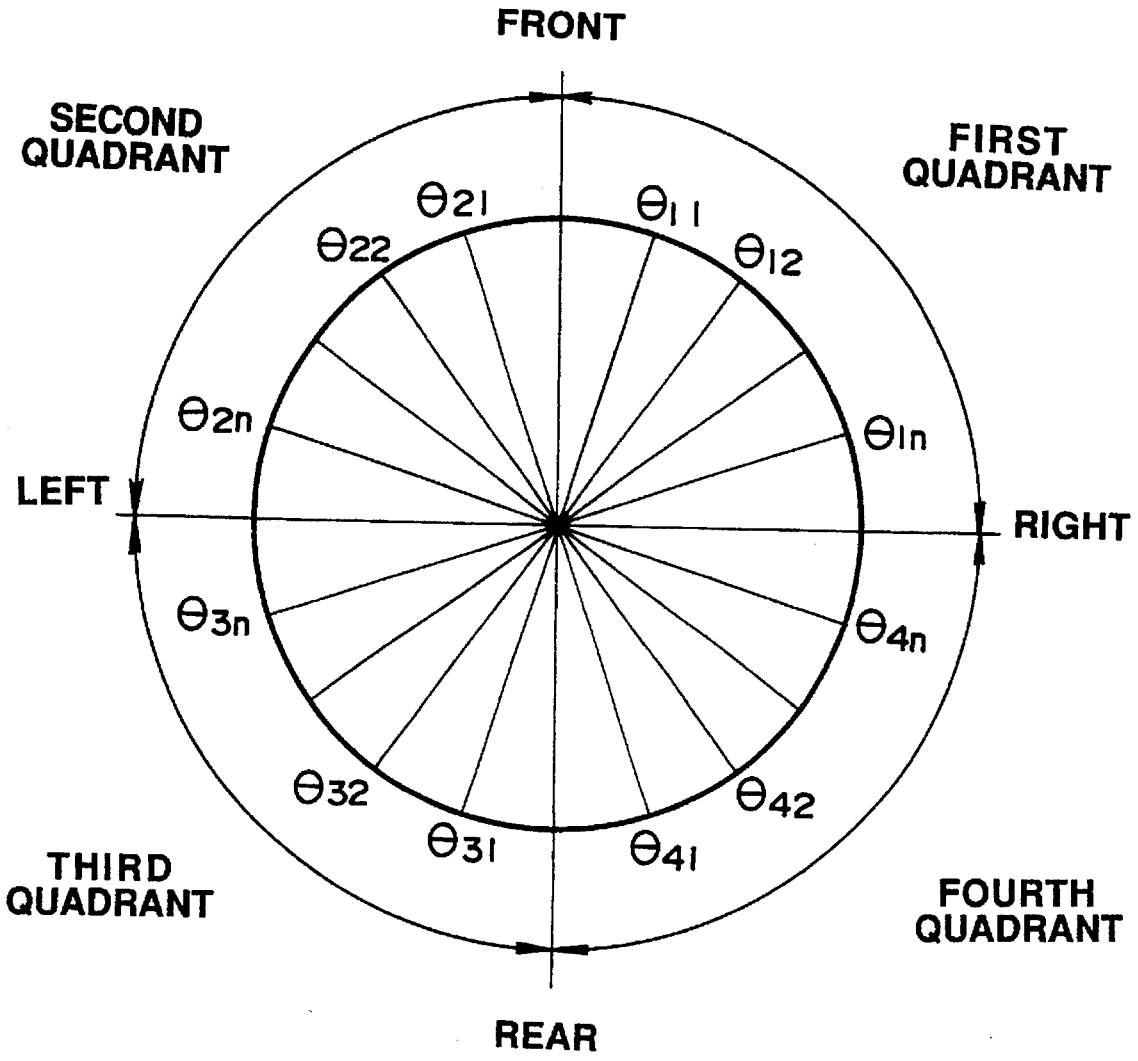
FIG. 4 is a view for explaining the information on the transfer characteristics stored in a storing circuit of the operation unit in the audio signal reproducing apparatus.

Based upon the current angle position calculated by the angle calculating circuit 20, the control circuit 21 reads the information for the transfer characteristics corresponding to the current angles $\theta_{11}$ to $\theta_{1n}$ positions from the storing circuit 22 and if the current angle position is in the first quadrant in FIG. 4 and reads the transfer characteristics information in which the current angles $\theta_{21}$ to $\theta_{2n}$ corresponds to the angles $\theta_{11}$ to $\theta_{1n}$ in the first quadrant from the storing circuit 22 if the current angle position is in the second quadrant in FIG. 4 and reads the transfer characteristics information in which the current angles $\theta_{31}$ to $\theta_{3n}$ corresponds to the angles $\theta_{11}$ to $\theta_{1n}$ in the first quadrant from the storing circuit 22 if the current angle position is in the third quadrant in FIG. 4 and reads the transfer characteristics information in which the current angles $\theta_{41}$ to $\theta_{4n}$ correspond to the angles $\theta_{11}$ to $\theta_{1n}$ in the first quadrant from the storing circuit 22 if the current angle position is in the fourth quadrant in FIG. 4 and supplies the read transfer characteristics information to an audio signal processing circuit 23 together with a signal representative of the quadrant in which the current angular position is located.

Since the head of the listener is substantially spherical and rotary symmetrical, the transfer characteristics from the virtual sound sources to both ears of the listener can be treated as symmetrical in each quadrant.

Alternatively, in the control circuit 21, two transfer characteristics in the vicinity of the rotational angular position of the head represented by the angular position information may be read form the storing circuit 22 and the information for the transfer characteristics in the current head rotational angular position may be operated on by, for example, linear interpolation processing.

Left and right channel audio signals $S_L$ and $S_R$ which are outputted from the audio signal source 24 are supplied to the audio signal processing circuit 23.

The audio signal source 24 is an apparatus for outputting given left and right channel audio signals $S_L$ and $S_R$, such as from recording disc playback apparatus or radio communication receivers and the like.

The audio signal processing circuit 23 performs a signal processing which provides the left and right channel audio signals $S_L$ and $S_R$ fed from the audio signal source 24 with a given transfer characteristics from the virtual sound source to both ears of the listener. The audio signal processing circuit 23 comprises first to sixth switches 25L, 25R, 26L, 26R, 27L and, 27R for switching the signal lines and first to fourth signal processing units 28*a*, 28*b*, 28*c* and 28*d*.

The first to sixth switches 25L, 25R, 26L, 26R, 27L and 27R are controlled in response to a control signal from the control circuit 21 representative of the quadrant to which the current angular position belongs.

The first and second switches 25L and 25R perform switching of inputs of left and right channel audio signals $S_L$ and $S_R$ fed from the audio signal source 24 and supply the right channel audio signal $S_R$ to the first and second signal processing units 28*a* and 28*b* and supply the left channel audio signal $S_L$ to the third and fourth signal processing units 28*c* and 28*d* when the current angular position is: in the first or third quadrant and supply the left channel audio signal $S_L$ to the first and second signal processing unit 28*a* and 28*b* and supply the right channel audio signal $S_R$ to the third and fourth signal processing units 28*c* and 28*d* when the current angular position is in the second or fourth quadrant.

The third and fourth switches 26L and 26R perform switching of the output of the left and right channel audio signals $E_L$ and $E_R$ outputted from the audio signal processing circuit 23 and select as a right channel audio signal $E_R$ the output signal of the first adder 29R for adding the output signals of the first and third signal processing unit 28*a* and 28*c* and select as a left channel audio signal $E_L$ the output signal of the second adder $\mathbf{29}_L$ for adding the output signals of the second and fourth signal processing units 28*b* and 28*d* when the current angular position is in the first or third quadrant and select as a right channel audio signal $E_R$ the output signal of the first adder 29L and select as a left channel audio signal $E_L$ the output signal of the second adder 29L when the current angular position is in the second or the fourth quadrant.

The third and fourth switches $\mathbf{26}_L$ and $\mathbf{26}_R$ perform switching of filters for the left, and right channel audio signals $E_L$ and $E_R$ outputted from the audio signal processing circuit 23 and output the left and right audio signals $E_L$ and $E_R$ unswitched when the current angular position is in the second or fourth quadrant and output the audio signals $E_L$ and $E_R$ from which high frequency components have been removed by low pass filters 30L and 30R when the current angular position is in the second or fourth quadrant.

In each of signal processing units 28*a*, 28*b*, 28*c* and 28*d*, an impulse response representative of the transfer characteristics of the left and right channel audio signals $S_L$ and $S_R$ reproduced from a pair of left and right channel speakers which are virtual sound sources facing to a listener to each ear of the listener is preset based upon information on transfer characteristics supplied from the control circuit 21.

In other words, the first signal processing unit 28*a* presets the impulse response $\{h_{RR}(t, \theta)\}$ representative of transfer characteristics of the sound reproduced from the right channel audio signal $S_R$ to the right ear. The second signal processing unit 28*b* presets the impulse response $\{h_{RL}(t, \theta)\}$ representative of the transfer characteristics of the sound reproduced from the right channel audio signal $S_R$ to the left ear. The third signal processing unit 28*c* presets the impulse response $\{h_{LR}(t, \theta)\}$ representative of transfer characteristics of the sound reproduced form the left channel audio signal $S_L$ to the right ear. The fourth signal processing unit 28*d* presents the impulse response $\{h_{LL}(t, \theta)\}$ representative of the transfer characteristics of the sound reproduced from the left channel audio signal $S_L$ to the left ear.

When the current angular position of the head of the listener is in the first quadrant, the right channel audio signal $S_R$ is fed to the first and second signal processing units 28*a* and 28*b*. In the first signal processing unit 28*a*, the right channel audio signal $S_R$ is subjected to a signal processing of convolution-integration of the impulse response $\{h_{RR}(t, \theta)\}$. In the second signal processing unit 28*b*, the right channel audio signal $S_R$ is subjected to a signal processing of convolution-integration of the impulse response $\{h_{RL}(t, \theta)\}$.

The left channel audio signal $S_L$ is fed to the third and fourth signal processing units 28*c* and 28*d*. In the third signal processing unit 28*c*, the left channel audio signal $S_L$ is subjected to a signal processing of convolution-integration of the impulse response $\{h_{LR}(t, \theta)\}$. In the second signal processing unit 28*d*, the left channel audio signal $S_L$ is subjected to a signal processing of convolution-integration of the impulse response $\{h_{LL}(t, \theta)\}$.

The output signals from the first and third signal processing units 28*a* and 28*c* are applied to the right channel adder 29R and are added with each other therein. The output signal of the right channel adder 28R is fed as the right channel studio signal $E_R$ via the right channel amplifier 31R to the right channel headphone 2R and reproduced as a sound. The output signals from the second and fourth signal processing unless 28*b* and 28*d* are applied to the left channel adder 29L and are added with each other therein. The output signal of the left channel adder 29 is fed as the left channel audio signal $E_L$ via the left channel amplifier 31L to the left channel headphone 2L and reproduced as a sound.

When the current angular position of the head of the listener is in the second quadrant, the left and right channels of inputs and outputs are replaced with each other and a processing which is similar to that of the foregoing first quadrant is performed. Accordingly, a front localization sensation is provided. When the current angular position of the head of the listener is in the third and fourth quadrants a processing which is similar to those of the first and second quadrants is performed. Audio signals $E_L$ and $E_R$ from which high frequency components have been removed from the low pass filters 30L and 30R are outputted. Accordingly, rear localization sensation can be provided.

In the audio signal reproducing apparatus of the thus formed embodiment, information on the transfer characteristics in the rotational angular positions corresponding to the movement of the head of the listener calculated by the angle calculating circuit 20 is formed based upon the information upon the transfer characteristics of the first quadrant stored in the storing circuit 22. By performing a signal processing of the left and right channel audio signals $S_L$ and $S_R$ which responds to changes in transfer characteristics in association with the movement of the listener P and the rotation of the head M in real time in the audio signal processing circuit 23 based upon the transfer characteristics data, good outside head localization sensation and front localization sensation are obtained in which the virtual sound sources are not moved as similarily to the case in which an audio signal is reproduced by a pair of speaker systems $S_L$ and $S_R$ which faces to the listener P and are remote therefrom and with each other as is shown in FIGS. 5A, 5B and 5C in which relative positional relations between the virtual sound sources and the listener P are illustrated.

Figure 5A:
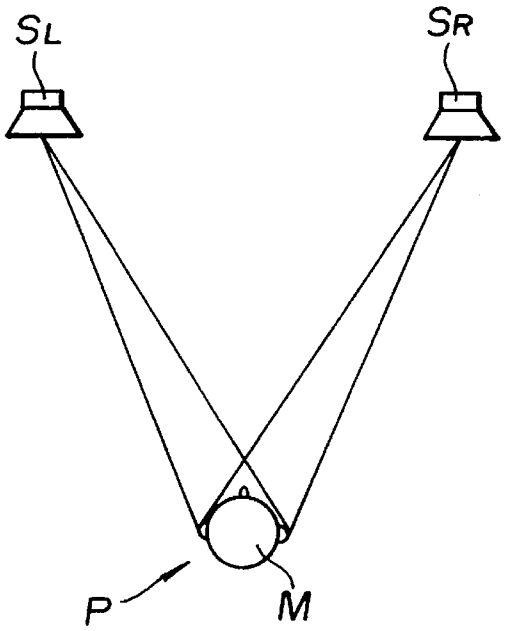
FIGS. 5(A)–5(C) are plan views showing the relative positional relation between virtual sound sources and a listener for explaining the operation of binaural reproducing performed by the audio signal reproducing apparatus.
Figure 5B:
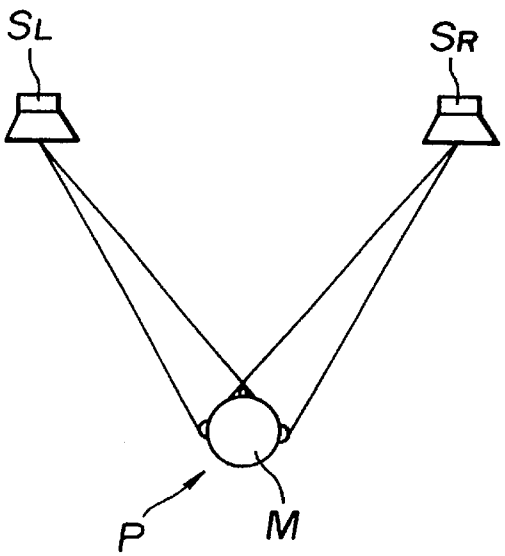
Figure 5C:
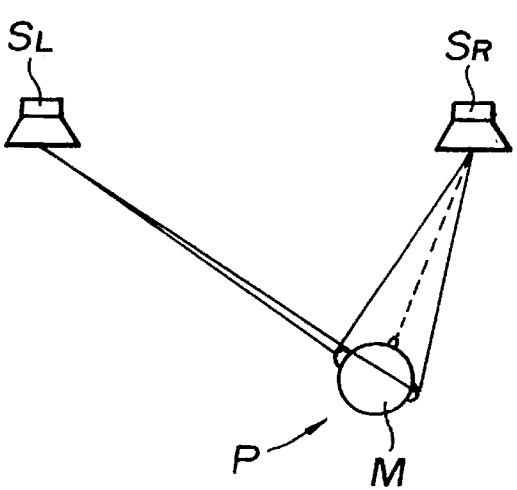

FIG. 5B shows that the listener P has approached to a pair of speaker systems $S_L$ and $S_R$, that is, virtual sound sources from a position of FIG. 5A. FIG. 4C shows that the listener P rotates his head M toward the right speaker device $S_R$. By performing a signal processing which can respond in real time to changes in transfer characteristics in association with the movement of the listener and the rotation of the head M as mentioned above in the audio signal reproduction apparatus of the present embodiment, good head outside and front localization sensation in which no virtual sound source is moved can be obtained so that a binaural reproduction which can respond to any conditions of FIGS. 5A, 5B and 5C can be performed.

Since it suffices for the audio signal reproducing apparatus of the present invention to store in storing means transfer characteristics information representative of the transfer characteristics from virtual sound sources to a listener of at least the first quadrant of the rotational angular position of the head of the listener, the amount of the information of the transfer characteristics to be stored in the storing means is small and a storing means which has a small storing capacity can be used. The audio signal processing means forms the transfer characteristics information in the rotational angular position represented by a detection output from detecting means for detecting the rotational angular position depending upon the movement of the head of the listener in accordance with the transfer characteristics information of at least the first quadrant stored in the storing means and processes the left and right channel audio signals for supplying the processed audio signals to the headphone set. Accordingly, a proper binaural reproduction can be performed for providing a very natural sound image localization sensation in which the positions of the virtual sound sources are not moved even if the listener moves.

A second embodiment of an audio signal reproducing apparatus of the present invention will now be described in detail with reference to the drawings.

Figure 6:
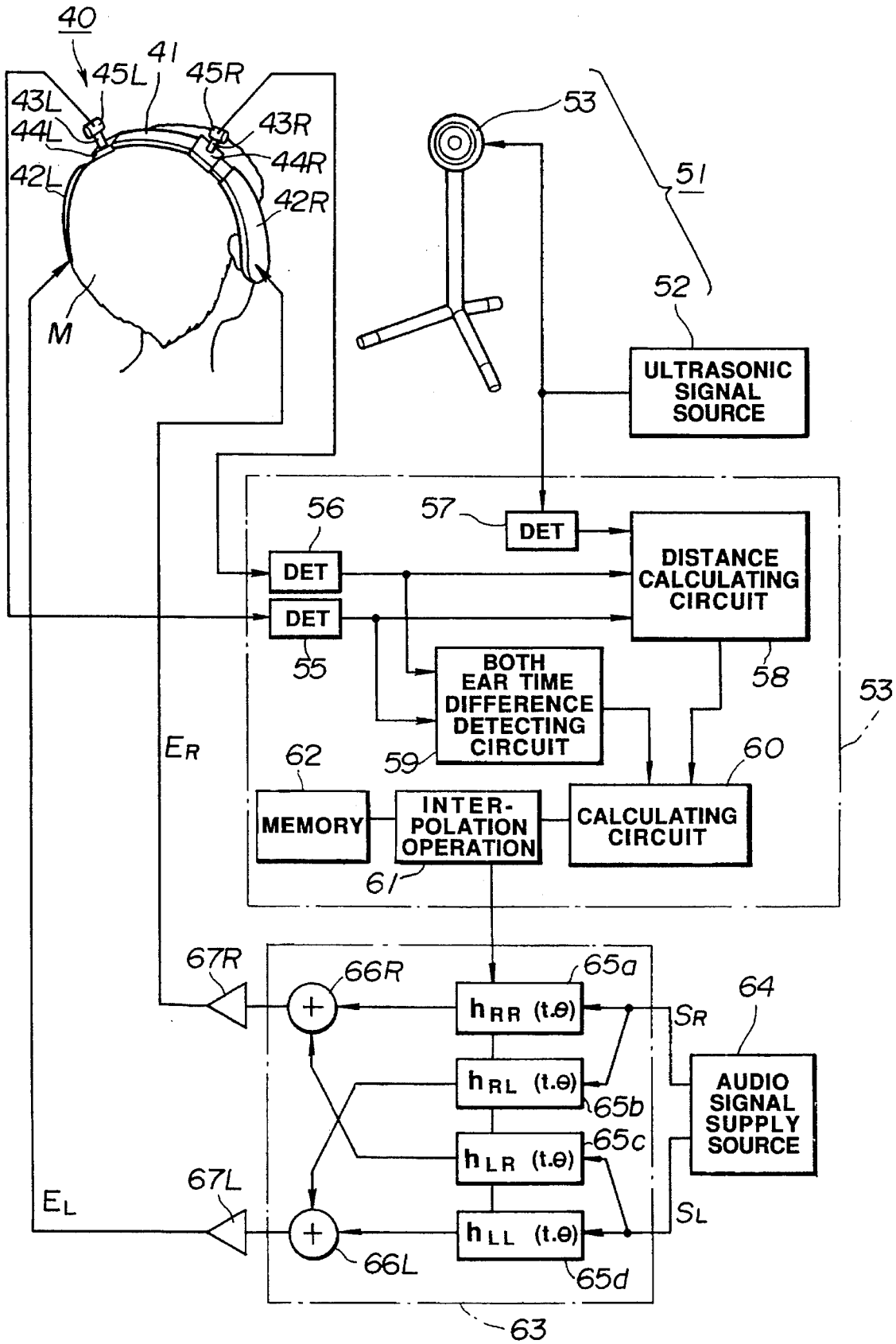
FIG. 6 is a block diagram schematically showing the other structure of the audio signal reproducing apparatus of the present invention.

The audio signal reproducing apparatus of the present invention shown in FIG. 6 comprises a headphone set 40 which is fitted over the head M of a listener P and a pair of headphones 42L and 42R are supported by a head band 41 so that they are located in the vicinity of left and right ears of the listener P, as is similar to the embodiment shown in FIG. 1.

Two sliders 44L and 44R from which support arms 43L and 43R, respectively project are slidably mounted on the head 1 of the headphone set 40. A pair of signal detectors 45L and 45R which detect a position detection reference signal emitted from a reference signal source 51 are provided at the tip ends of the support arms 43L and 43R, respectively. That is, the pair of signal detectors 45L and 45R are provided on the tip ends of the support arms 43L and 43R formed on the sliders 44L and 44R which are slidably mounted on the head band 51 so that they are supported in positions remote from the head band 51 and the pair of headphones 42L and 42R, that is the main body of the headphone set.

Also in this present embodiment, the reference signal source 51 comprises an ultrasonic signal source 52 and an ultrasonic speaker 53 for generating an ultrasonic signal from the ultrasonic signal source 52 as a reference signal. Each of the pair of signal detectors 45L and 45R which receives the reference signal comprises an ultrasonic microphone.

An ultrasonic wave generated from the ultrasonic speaker 53, that is, the position detection reference signal is a burst wave in which an ultrasonic wave having a given level is intermittently generated for a given period of time as is similar to the first embodiment, or an ultrasonic wave, the phase of which may be detected like a so-called level modulated wave, the level of which changes in a given circle.

The pair of signal detectors 45L and 45R provided on the headphone set 40 detects the ultrasonic position detection reference signal generated from the ultrasonic speaker 53 and generate respective detection signals, each having a time lag depending upon the relative positional relation between the listener P and the ultrasonic speaker 53.

Each detection signal obtained by these signal detectors 45L and 45R is applied to an operation unit 53.

The operation unit 53 comprises first and second edge detecting circuit 55 and 56, to which the detection signal from the signal detectors 45L and 45R for detecting the position detection reference signal are supplied, respectively and a third edge detecting circuit 57 to which an ultrasonic signal from the ultrasonic signal source 52, that is, the position detection reference signal is applied.

The first and second edge detecting circuits 55 and 56 detect rise-up edges of the detection signals generated from the signal detectors 45L and 45R, respectively and output pulse signals corresponding to the rise-up edges pulse signals generated by the first and second edge detecting circuits 55 and 56 are supplied to a distance calculating circuit 58 and a circuit 59 for detecting the time difference between both ears. The third edge detecting circuit 57 detects the rise-up edge of the ultrasonic signal from the ultrasonic signal source 52 and outputs a pulse signal corresponding to the rise-up edge. A pulse signal obtained by the third edge detection circuit 57 is supplied to the distance calculating circuit 58.

The distance calculating circuit 58 detects the time difference $t_1$ between pulse signals obtained by the third and first edge detecting circuits 57 and 55 and the time difference $t_2$ between pulse signals obtained by the third and second edge detecting circuits 57 and 56 and then calculates the distance $\iota_0$ between the ultrasonic speaker 53 and the center of the head M of the listener based upon the time differences $t_1$, $t_2$ and the sound velocity V.

Signals representative of the distance $\iota_0$, time differences $t_1$ and $t_2$ are fed to an angle calculating circuit 60.

The circuit 59 for detecting the time difference between both ears detects the time difference $t_3$ between the pulse signals generated by the first and second edge detecting circuits 55 and 56. A signal representative of the time difference $t_3$ is fed to the angle calculating circuit 60.

The angle calculating circuit 60 calculates an angle $\theta_0$ representative of the direction of the head M by using the time differences $t_1$, $t_2$, $t_3$, the distance $\iota_0$, the sound velocity V and the radius r of the head similarly to the angle calculating circuit 20 in the first embodiment.

Information of the rotation angular position head of the listener obtained by the angle calculating circuit 60 is provided to an interpolation operation and processing circuit 61.

In the audio signal reproducing apparatus of the present embodiment, the operation unit 53 includes a storing circuit 62 in which transfer characteristics information representative of the transfer characteristics from the virtual sound sources to both ears of the listener for each predetermined angle, which is larger than that of the angular positional information of the listener calculated by the angle calculating circuit 60.

The interpolation operation and processing circuit 61 reads the information on two transfer characteristics in the vicinity of the rotational angular position of the head representing the current angular positional information calculated by the angle calculating circuit 60 and operates the transfer characteristics in the current rotational angular position of the head by, for example, a linear interpolation processing.

The interpolation operation and processing circuit 61 may read the information for more than two transfer characteristics in the vicinity of the current rotational angular position of the head represented by the angular positional information for performing secondary interpolation processing other than the linear interpolation processing.

The information on the transfer characteristics in the current rotational angular position obtained by the interpolation operation and processing circuit 61 is supplied to an audio signal processing circuit 63.

The audio signal processing circuit 63 is also supplied with left and right channel audio signals $S_L$ and $S_R$ outputted from an audio signal source 64.

The audio signal source 64 is a device for outputting predetermined left and right channel audio signals $S_L$ and $S_R$ and may include, for example, various outs of recording disc playback devices, recording the playback device of wireless receivers and the like.

The audio signal processing circuit 63 performs a signal processing which provides the left and right channel audio signals $S_L$ and $S_R$ fed from the audio signal source 64 with a given transfer characteristics from the virtual sound source to both ears of the listener. The audio signal processing circuit 63 comprises first thorough fourth signal processing units 65*a*, 65*b*, 65*c* and 65*d* to which the transfer characteristics information in the current rotational angular positional of the head obtained by the interpolation operation and processing circuit 61. In each of the signal processing units 65*a*, 65*b*, 65*c* and 65*d*, an impulse response representative of the transfer characteristics of the left and right channel audio signals $S_L$ and $S_R$ reproduced from a pair of left and right channel speakers which are virtual sound sources facing to a listener to each ear of the listener is preset based upon information of the transfer characteristics.

In other words, the first signal processing unit 65*a* presents the impulse response $\{h_{RR}(t, \theta)\}$ representative of the transfer characteristics of the sound reproduced form the right channel audio signal $S_R$ to the right ear. The second signal processing unit 65*b* presents the impulse response $\{h_{RL}(t, \theta)\}$ representative of the transfer characteristics of the sound reproduced from the right channel audio signal $S_R$ to the left ear. The third signal processing unit 65*c* presets the impulse response $\{h_{LR}(t, \theta)\}$ representative of the transfer characteristics of the sound reproduced from the left channel audio signal $S_L$ to the right ear. The fourth signal processing unit 65*d* presets the impulse response $\{h_{LL}(t, \theta)\}$ representative of the transfer characteristics of the sound reproduced from the left channel audio signal $S_L$ to the left ear. In the audio signal processing circuit 63, the right channel audio signal $S_L$ is fed to the first and second signal processing units 65*a* and 65*n*. In the first signal processing unit 65*a*, the right channel audio signal $S_L$ is subjected to a signal processing of convolution-integration of the impulse response $\{h_{RR}(t, \theta)\}$. In the second signal processing unit

65*b*, the right channel audio signal $S_R$ is subjected to a signal processing of convolution-integration of the impulse response $\{h_{RL}(t, \theta)\}$.

The left channel audio signal $S_L$ is fed to the third and fourth signal processing units 65*c* and 65*d*. In the third signal processing unit 65*c*, the left channel audio signal $S_L$ is subjected to a signal processing of convolution-integration of the impulse response $\{h_{LR}(t, \theta)\}$. In the second signal processing unit 65*d*, the left channel audio signal S is subjected to a signal processing of convolution-integration of the impulse response $\{h_{LL}(t, \theta)\}$.

The output signals from the first and third signal processing units 65*a* and 65*c* are applied to the right channel adder 66R and are added with each other therein. The output signal of the right channel adder 66R is fed as the right channel audio signal $E_R$ via the right channel amplifier 68R to the right channel headphone 4R of the headphones 40 and reproduced as a sound. The output signals from the second and fourth signal processing units 64*b* and 64*a* are applied to the left channel adder 66L and are added with each other therein. The output signal of the right channel adder 66L is fed as the left channel audio signal $E_R$ via the left channel amplifier 68L to the left channel headphone 42L of the headphone set 40 and reproduced as a sound.

In the thus formed audio signal reproducing apparatus of this embodiment, information of two transfer characteristics in the vicinity of the rotational angular position represented by the current angular positional information is read from the storing circuit 62 based upon the current angular positional information calculated by the angle calculating circuit 60. The transfer characteristics information in the current rotational angular position are operated on by a linear interpolation processing in the interpolation operation circuit 61. By performing a signal processing which responds to changes in transfer characteristics in association with the movement of the listener and the rotation of the head M in real time in the audio signal processing circuit 63 based upon the transfer characteristics data, good outside head localization sensation and front localization sensation are obtained in which the virtual sound sources are not moved as similarly to the case in which an audio signal is reproduced by a pair of speaker systems which faces to the listener and are remote therefrom and with each other.

As mentioned above, in the audio signal reproducing apparatus of the present invention, information for at least two transfer characteristics in the vicinity of the rotational angular position of the head represented by the detection output from detecting means for detecting the rotational angular position of the head of the listener at a solution higher than that of the transfer characteristics information stored in the storing means is read from the storing means. The transfer characteristics information in the rotational angular position of the head represented by the detection output are interpolation-operated on an interpolation operation means. Accordingly, the amount of the information on the transfer characteristics stored in the storing means can be reduced. The audio signal processing means processes the left and right channel audio signals based upon the transfer characteristics information determined by the interpolation operation means. The processed audio signals are supplied to the headphones, resulting in that a proper binaural reproduction can be achieved for providing very natural sound image localization sensation in which the positions of the virtual sound sources do not move even if a listener moves.

What is claimed is:

1. An audio signal ear phone reproducing apparatus, comprising:

means for detecting the rotational angular position of the head of a listener corresponding to the movement of the head of the listener relative to virtual sound sources including first and second detectors mounted on the listeners head and a third detector mounted at a fixed location and said first second and third detectors receiving position information from a transmitter, means for storing transfer characteristics information representative of transfer characteristics of direct sounds from said virtual sound sources to both ears of the listener for each predetermined rotational angular position in at least the first quadrant; and audio signal processing means which based upon the transfer characteristics information of at least one quadrant which is stored in said storing means, forms a new transfer characteristic information for the right and left ears according to the rotational angular position of the head represented by an detection output of said detecting means for producing left and right channel input audio signals, whereby said audio signals which have been processed by said audio signal processing means by using said new transfer characteristic information are reproduced as sounds by headphone means, in which said storing means preliminarily stores the transfer characteristics information representative of the transfer characteristics from said virtual sound sources to both ears of the listener in the first quadrant of the rotational angular position of the head, further including control means which reads from said storing means the transfer characteristics information in the first quadrant corresponding to the rotational angular position of the head represented by the detection output from said detection means for supplying said audio signal processing means with the read transfer said new characteristics information together with a control signal representative of which quadrant the rotational angular position represented by the detection output from said detecting means belongs to, in which said audio signal processing means includes;

a first signal processor for applying to the right channel said input audio signal for the right ear an impulse response $(h_{RL}(t,\mathbf{0})$ corresponding to said new transfer characteristics for a right channel input audio signal of an input audio signal to the right ear;

a second signal processor for applying to the right channel input audio signal an impulse response $(h_{LR}(t,\mathbf{0}))$ corresponding to the transfer characteristics of the right channel reproduced audio signal to the left ear;

a third signal processor for applying to the left channel input audio signal for the left ear an impulse response $(h_{LL}(t,\mathbf{0}))$ corresponding to said new transfer characteristics for a the left channel input reproduced audio signal of the input audio signal to the right ear;

a fourth signal processor for applying to the left channel input audio signal an impulse response corresponding to the transfer characteristics of the left channel reproduced audio signal to the left ear;

a first means for adding the output of said first signal processing unit with the output of the third signal processing unit;

a second means for adding the output of said second signal processing unit with the output of the fourth signal processing unit whereby the outputs of the first and second adding means are supplied to the right and left channel headphones of said headphone set respectively, and in which said audio signal processing means includes;

a first selecting means for supplying said right channel input audio signal to said first and second signal processing unit when the control signal represents the first or third quadrant and for supplying said right channel input audio signal to the third and fourth signal processing units when the control signal represents the second or fourth quadrant;

a second selecting means for supplying the left channel input audio signal to the third and fourth signal processing units when said control signal represent the first or third quadrant and for supplying the right channel input audio signal to the first and second signal processing units when the control signal represent the second or fourth quadrant;

a third selecting means for selecting the output of said first adding means when said control signal represents the second or fourth quadrant and for selecting the output of said second adding; means when said control signal represents the second or fourth quadrant;

a fourth selecting means for selecting the output of said second adding means when the control signal represents the first or third quadrant and for selecting the output of the first adding means when the control signal represents the second or fourth quadrant;

a fifth selecting means for supplying the output of said third selecting means to the right channel headphone of the headphone set when said control signal represents the first or third quadrant and for supplying the output of the third selecting means to the right channel headphone of the headphone set via a low pass filter when said control signal represents the second and fourth quadrant; and a sixth selecting means for supplying the output of said fourth selecting means to the left channel headphone of the headphone set when said control signal represents the first or third quadrant and for supplying the output of the fourth selecting means to the left channel headphone of the headphone set via a low pass filter when the control signal represents the second or fourth quadrant.

* * * * *